US006170085B1

(12) United States Patent
Maggert

(10) Patent No.: US 6,170,085 B1
(45) Date of Patent: Jan. 9, 2001

(54) COMBINATION LINT BRUSH AND NECKTIE

(76) Inventor: Josh Maggert, 109 1/2 Riverside Dr., Piqua, OH (US) 45356

( * ) Notice: Under 35 U.S.C. 154(b), the term of this patent shall be extended for 0 days.

(21) Appl. No.: 09/418,547

(22) Filed: Oct. 14, 1999

(51) Int. Cl.[7] ..... A41D 25/00

(52) U.S. Cl. ..... 2/157; 2/144

(58) Field of Search ..... 2/157, 144, 145, 2/156, 605; D4/116, 137; D2/605

(56) References Cited

U.S. PATENT DOCUMENTS 3,842,436 * 10/1974 Hirschson ..... 2/157
5,285,312 * 2/1994 Mastro ..... 359/516
5,745,918 * 5/1998 Shukla et al. ..... 2/144

* cited by examiner

*Primary Examiner*—John J. Calvert
*Assistant Examiner*—Alissa L. Hoey
(74) *Attorney, Agent, or Firm*—John D. Gugliotta

(57) ABSTRACT

A lint brush in combination with a conventional necktie is proved whereby a section of lint removing bristled material is sewn into the "V" portion on the lower end on the backside of the necktie.

3 Claims, 2 Drawing Sheets

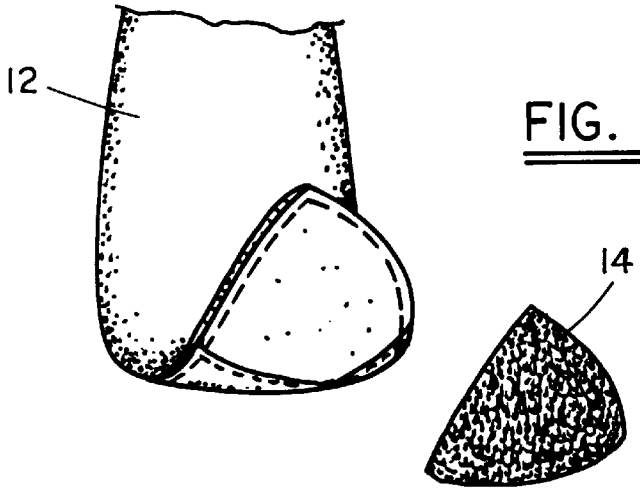
FIG. 2
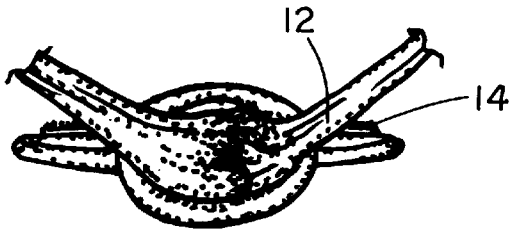
FIG. 3
FIG. 4
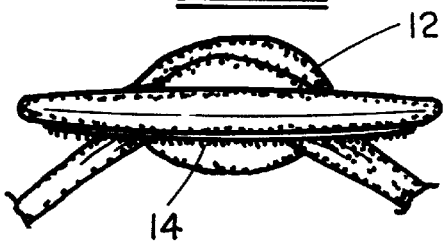
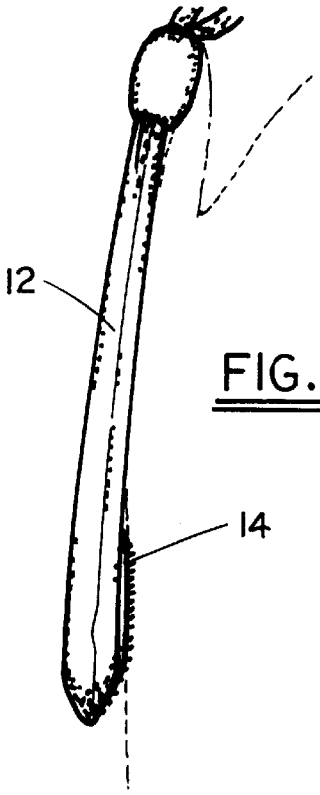
FIG. 5

COMBINATION LINT BRUSH AND NECKTIE

RELATED APPLICATIONS

The present invention was first described in Disclosure Document Number 459,119 filed on Jul. 19, 1999. There are no previously filed, nor currently any co-pending applications, anywhere in the world.

BACKGROUND OF THE INVENTION

1. Field of the Invention

The present invention relates generally to both lint brush devices and neckties and, more particularly, to a combination lint brush and necktie.

2. Description of the Related Art

In the related art, many devices are known that disclose the design and function of a lint removal brush. These include U.S. Pat. No. 5,148,571 issued in the name of Brazis et al. Also, U.S. Pat. No. D 362,965 issued in the name of Tastanis, U.S. Pat. No. D 324,779 issued in the name of Ueda, U.S. Pat. No. D 313,509 issued in the name of Ueda, U.S. Pat. No. D 309,378 issued in the name of Kiesz, U.S. Pat. No. D 309,376 issued in the name of Kiesz, and U.S. Pat. No. D 281,291 issued in the name of Schuler, III.

Other art is also generally known. U.S. Pat. No. 4,642,835 issued in the name of Schmitz describes a combination lint brush and shoe polishing brush. U.S. Pat. No. D 313,088 issued in the name of Her discloses the ornamental design of a combination lint brush, comb, and shoehorn.

However, nowhere in the art is an apparatus that provides the functions of a conventional necktie and incorporates a built in lint brush for removing lint, hair and similar undesired items from one's clothing.

SUMMARY OF THE INVENTION

The present invention, when outwardly viewed, appears identical to that of a conventional necktie. It can be made from any material that is used to make conventional neckties, including silk, and synthetic blends. The invention is routed around the wearer's neck and tied in any conventional manner. It can be secured with a tie clip or clasp also. The invention includes a small triangular shaped piece of material with short bristles on the rear side of the front tip of the tie. The material is identical in nature to that used on common lint removal brushes. When one wishes to remove lint or similar substances from their shirt or clothing, one simply takes the tie and brushes it over the offending object. The lint or similar item, is then removed.

The use of the present invention provides individuals one device that serves two functions that can be worn regardless of clothing style.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 2 is a partial exploded perspective view thereof;

FIG. 3 is a top plan view there;

FIG. 4 is a bottom plan view thereof; and

FIG. 5 is a side elevational view thereof.

DESCRIPTION OF THE PREFERRED EMBODIMENTS

Figure 1:
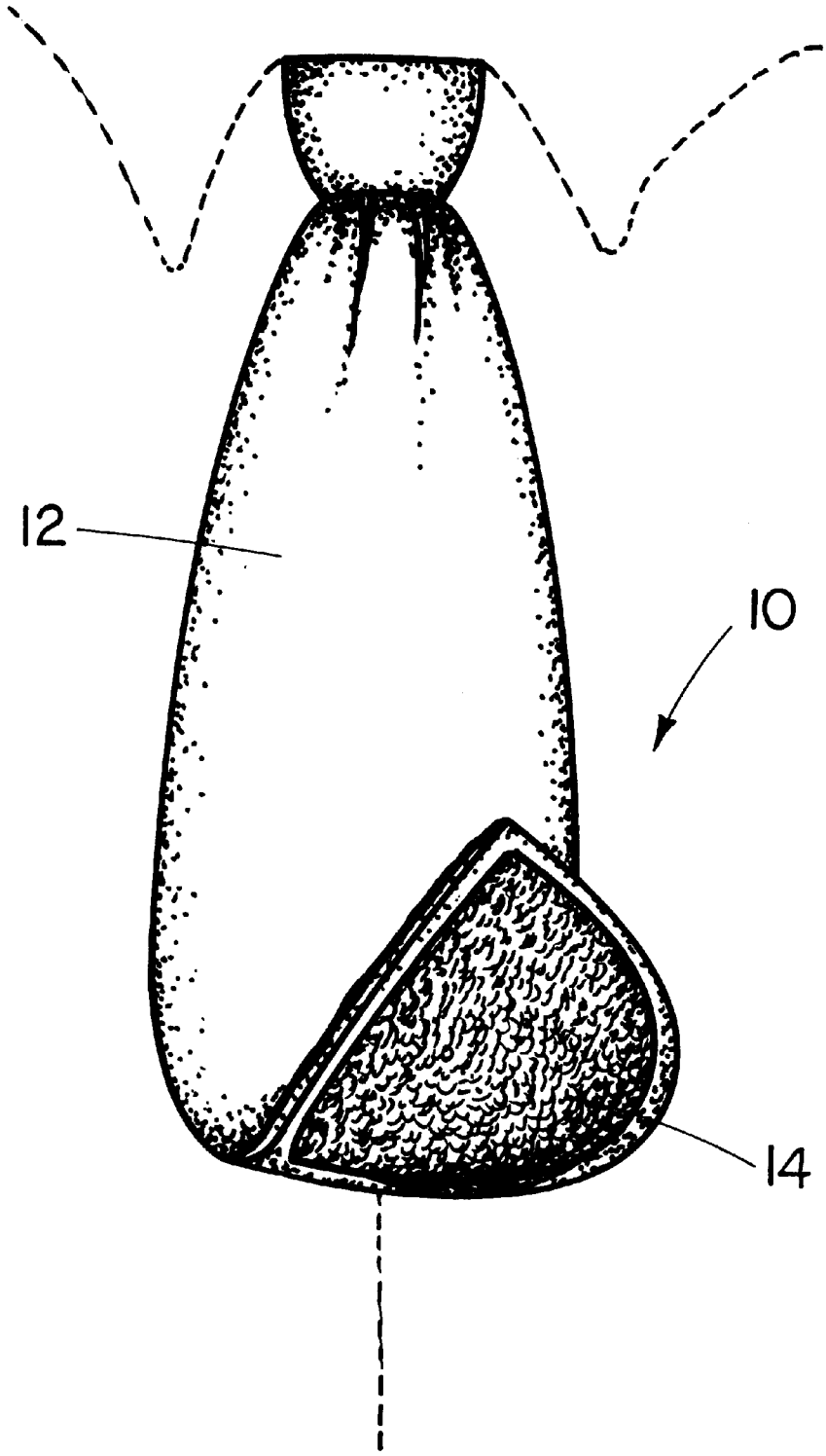
FIG. 1 is a perspective view of a combination lint brush and necktie apparatus according to the preferred embodiment of the present invention.

The best mode for carrying out the invention is presented in terms of its preferred embodiment, herein depicted within the Figures.

1. Detailed Description of the Figures

Referring now to FIG. 1, a combination lint brush and necktie apparatus, generally noted as 10 is shown, according to the present invention. When outwardly viewed, the present invention appears identical to that of an otherwise conventional necktie 12. It can be made from any material that is used to make conventional neckties, including silk, and synthetic blends. The invention is routed around the wearer's neck and tied in any conventional manner. It can be secured with a tie clip or clasp also.

In combination with the necktie element 12, the present invention includes a lint removal means 14 mounted within the inner lining of the tie element 12. In its preferred embodiment, and for purposes of disclosing the best mode of the invention, but not necessarily the only mode, the lint removal means 14 is shown as a small triangular shaped piece of material with short bristles on the rear side of the front tip of the tie 12. It is envisioned that the material is identical in nature to that used on common lint removal brushes.

2. Operation of the Preferred Embodiment

In operation, the present invention is utilized in the same manner as a conventional necktie. When one wishes to remove lint or similar substances from their shirt or clothing, one simply takes the tie and brushes it over the offending object. The lint or similar item, is then removed.

The foregoing description is included to illustrate the operation of the preferred embodiment and is not meant to limit the scope of the invention. The scope of the invention is to be limited only by the following claims.

What is claimed is:

1. A combination lint brush and necktie apparatus comprising:

a necktie element having an inner lining; and lint removal means mounted within said inner lining of said tie element.

2. The combination lint brush and necktie apparatus of claim 1, wherein said lint removal means comprises a triangular shaped piece of material with short bristles on a rear side of a front tip of the tie.

3. The combination lint brush and necktie apparatus of claim 1, wherein a section of lint removing bristled material is sewn into a "V" portion on a lower end on a backside of the necktie.

* * * * *